US005259851A

United States Patent [19]

Genova et al.

[11] Patent Number: 5,259,851

[45] Date of Patent: Nov. 9, 1993

[54] HYBRID LIQUID FUEL COMPOSITION IN AQUEOUS MICROEMULSION FORM

[75] Inventors: Calogero Genova, Vizzolo Predabissi; Rosario Pappa, Monterotondo, both of Italy

[73] Assignee: Eniricerche S.p.A., Milan, Italy

[21] Appl. No.: 649,578

[22] Filed: Feb. 1, 1991

[30] Foreign Application Priority Data

Feb. 2, 1990 [IT] Italy ..... 19242 A/90

[51] Int. Cl.[5] ..... C10L 1/32

[52] U.S. Cl. ..... 44/302; 44/313; 44/443; 44/445; 44/447

[58] Field of Search ..... 44/301, 302, 313, 443, 44/445, 447

[56] References Cited

U.S. PATENT DOCUMENTS

| | | | |
|---|---|---|---|
| 2,111,100 | 3/1938 | Kokatnur | 44/302 |
| 3,219,582 | 11/1965 | Gaertner | 44/313 |
| 3,876,391 | 4/1975 | McCoy et al. | 44/301 |
| 4,046,519 | 9/1977 | Piotrowski | 44/302 |
| 4,105,418 | 8/1978 | Mohnhaupt | 44/313 |
| 4,182,614 | 1/1980 | Moriyama et al. | 44/301 |
| 4,347,061 | 8/1982 | Madsen et al. | 44/302 |
| 4,392,865 | 7/1983 | Grosse et al. | 44/301 |
| 4,425,136 | 1/1984 | Pearson | 44/313 |
| 4,477,258 | 10/1984 | Lepain . | |
| 4,557,734 | 12/1985 | Schwab et al. | 44/302 |
| 4,608,057 | 8/1986 | Davis et al. . | |
| 4,744,796 | 5/1988 | Hazbun et al. | 44/302 |
| 4,892,560 | 1/1990 | Sial | 44/301 |

*Primary Examiner*—Margaret Medley
*Attorney, Agent, or Firm*—Shea & Gould

[57] ABSTRACT

A hybrid fuel composition in the form of a stable water-in-oil microemulsion comprises a liquid hydrocarbon fuel, water, a glycolipid surfactant and a vicinal aliphatic diol co-surfactant. The hydrocarbon fuel can be a liquid fuel for autotraction such as gasoline or diesel fuel, or a liquid hydrocarbon fuel for domestic or industrial heating, such as gas oil, naphtha, kerosene and fuel oils in general.

14 Claims, No Drawings

HYBRID LIQUID FUEL COMPOSITION IN AQUEOUS MICROEMULSION FORM

This invention relates to a hybrid liquid hydrocarbon fuel hydrocarbon in the form of a stable water-in-oil microemulsion, its preparation and its use.

In recent years various studies have been undertaken in the field of liquid hydrocarbon fuels with the object of improving their combustion characteristics. In particular, attention has been directed towards liquid fuel compositions possessing water tolerance, in that the presence of water enables the combustion temperature to be reduced with a consequent reduction in smoke emission and carbon monoxide and nitrogen oxide formation in the burnt gases.

For example, U.S. Pat. Nos. 4,451,265 and 4,447,258 and European patent application 58,605 describe compositions containing a hydrocarbon fuel of the diesel or gasoline type, an aliphatic alcohol and water, these being maintained in emulsion or microemulsion form by a surfactant or a mixture of surfactants. The most serious drawbacks of these compositions are the large quantity of surfactant required to obtain emulsions or microemulsions with a satisfactory water content and stability, and the ash which some types of surfactants form during combustion. U.S. patent application Ser. No. 529,179 of May 25, 1990 in the name of the present applicant describes a hybrid diesel fuel composition stable within a wide temperature range, which contains water, a glycolipid surfactant and an aliphatic alcohol co-surfactant.

It has now been found that the use of the glycolipid surfactant of the said U.S. patent application combined with a vicinal aliphatic diol surfactant enables water-in-oil microemulsions to be obtained practically with any liquid hydrocarbon fuel. These compositions possess a set of characteristics which are unexpectedly good in terms of their stability and their high water content for the small quantity of surfactant and co-surfactant used.

In accordance therewith, the present invention provides a hybrid fuel composition in the form of a stable water-in-oil microemulsion, comprising a liquid hydrocarbon fuel, water, a glycolipid surfactant and a vicinal aliphatic diol co-surfactant. In the present description, the term "water-in-oil microemulsions" means a colloidal dispersion which is transparent and stable within a wide temperature range and able to spontaneously form components, in which the mean diameter of the particles of the dispersed phase (water) is less than one quarter of the wavelength of visible light.

The liquid hydrocarbon of the composition of the present invention can be a gasoline or a diesel fuel.

In particular, normal internal combustion engine gasoline can be used consisting essentially of volatile liquid hydrocarbons of which at least 95% distils within 225° C. and which are obtained from crude petroleum by distillation, reforming, polymerization, catalytic cracking and alkylation. Both gasoline containing lead antiknock additives and unleaded gasoline are suitable for the purpose.

The diesel fuel can be any petroleum fraction which satisfies ASTM standards for fuels for internal combustion in diesel engines and usually consists of the crude petroleum fraction which distils after kerosene. Of the various diesel fuels, diesel fuel No. 2 is preferred, as it is most commonly used for commercial and agricultural vehicles.

The liquid hydrocarbon fuel of the present invention can also consist of any liquid fuel normally intended for domestic or industrial heating, such as gas oil, naphtha, kerosene and fuel oils in general.

The glycolipid surfactant used in the present invention is a compound generally definable by the formula:

$$A—X—R \qquad (I)$$

where:

A represents the glucide group of a mono-, di-, tri- or tetra-saccharide,

R represents a linear or branched chain alkyl group with at least 10 carbon atoms, and either saturated or containing one or more ethylenic unsaturations, X represents a group connecting together the two groups A and R, and chosen from ether, ester, acetal and hemiacetal functions.

These glycolipid surfactants can be prepared by reacting a saccharide with a suitable alkyl halide (formation of an ether bond) or with a suitable lower aliphatic acid or a relative ester (formation of an ester bond), or with a suitable aliphatic aldehyde (formation of an acetal or hemiacetal bond). In these reactions, saccharide monosubstitution products form together with smaller or larger quantities of polysubstitution products.

Further according to the present invention, either the monosubstitution products can be separated for use as glycolipid surfactants or the mono- and poly-substituted product mixture can be used for the same purpose.

In the preferred embodiment, the saccharide is saccharose and the alkyl chain contains from 10 to 24 carbon atoms. Specific examples of glycolipid surfactants are: oleyl saccharose ether, tetradecyl saccharose ether, dodecyl saccharose ether, saccharose oleate ester, saccharose laurate ester, saccharose linoleate ester and saccharose ether produced from the commercial alcohols with a linear or branched chain, after transforming into the relative alkyl halide.

With regard to the glycolipid surfactants and the processes for their preparation, reference should be made to L. Osipow et al., Industrial and Engineering Chemistry, vol. 48, No. 9, September 1956, pages 1459–1461; B. Havlinova et al., Tenside Detergents 15 (1978) 2, pages 72–74 and 15 (1978) 3, pages 119–121.

The co-surfactant of the compositions of the present invention is a vicinal aliphatic diol definable by the following formula:

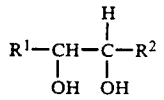

(II)

where:

$R^1$ represents a $C_4$–$C_{12}$ linear or branched alkyl group possibly interrupted by one or more oxygen atoms or carboxy groups and possibly carrying one or more ethylenic saturations;

$R^2$ represents a hydrogen atoms, a methyl or ethyl group, or has the same meaning as $R^1$.

In the preferred embodiment:

$R^1$ in the co-surfactant formula (II) represents a linear or branched $C_5$–$C_{10}$ alkyl group; an $R^3$—COO—$CH_2$— alkylcarboxymethylenic group where $R^3$ represents a linear or branched $C_5$–$C_{10}$ alkyl group; or an $R^4$—O—($CH_2$—$CH_2$—O)$_n$— alkylethoxy group where $R^4$ represents a linear or branched $C_5$–$C_8$ alkyl group and n is 1 or 2; and $R^2$ represents a hydrogen atom.

Specific examples of co-surfactants suitable for the purpose of the present invention are 1,2-octanediol, 1,2-nonanediol, 1,2-decanediol, 1,2-dodecanediol, a glycerol monoester or a glycerol diester.

The composition of the present invention generally contains the following constituent quantities: liquid hydrocarbon fuel 72–97.5 wt %, water 1–13 wt %, glycolipid surfactant 0.9–9.6 wt % and vicinal aliphatic diol co-surfactant 0.6–6.4 wt %. In addition a weight ratio of surfactant to co-surfactant of between 1:1 and 2:1 is conveniently maintained in the composition.

In the preferred embodiment, the composition of the present invention contains the following constituent quantities: liquid hydrocarbon fuel 80–95 wt %, water 3–10 wt %, glycolipid surfactant 1.2–6.6 wt % and vicinal aliphatic diol co-surfactant 0.8–4.4 wt %, with a weight ratio of surfactant to co-surfactant of the order of 1.5:1.

The composition of the present invention preferably contains leaded or unleaded gasoline or diesel fuel as its liquid hydrocarbon constituent.

In the case of leaded or unleaded gasoline the composition constituents are generally present in the following quantity ranges: gasoline 73–97.5 wt %, water 1–13 wt %, glycolipid surfactant 0.9–8.4 wt % and vicinal aliphatic diol co-surfactant 0.6–5.6 wt %, and preferably in the following ranges: gasoline 81–95 wt %, water 3–10 wt %, glycolipid surfactant 1.2–5.4 wt % and vicinal aliphatic diol co-surfactant 0.8–3.6 wt %.

In the case of diesel fuel, the composition constituents are generally present in the following quantity ranges: diesel fuel 72–96.5 wt %, water 1–12 wt %, glycolipid surfactant 1.5–9.6 wt % and vicinal aliphatic diol co-surfactant 1.0–6.4 wt %, and preferably in the following ranges: diesel fuel 80–93.4 wt %, water 3–9 wt %, glycolipid surfactant 2.2–6.6 wt % and vicinal aliphatic diol co-surfactant 1.4–4.4 wt %.

The composition of the present invention can additionally contain smaller quantities (generally less than 1 wt %) of known additives soluble in the oil or water phase, such as octane number or cetane number improvers, corrosion inhibitors, metal deactivators, antifreeze agents, antioxidants etc. depending on the use for which the composition is intended.

The method of preparation of the composition is not critical as the microemulsion forms spontaneously by simple contact and homogenization between the constituents.

The composition of the present invention is stable within a wide temperature range, enabling it to be stored under various climatic conditions without danger of irreversible separation. In addition the composition supports relatively larger water quantities for a small surfactant and co-surfactant content. When in use, the composition burns with low carbon monoxide and nitrogen oxide formation and with no ash formation.

The following experimental examples are provided to further illustrate the present invention.

EXAMPLE 1

Microemulsion samples are prepared from gasoline, water, saccharose laurate as surfactant and 1,2-octanediol as co-surfactant. The gasoline is an unleaded gasoline produced commercially by Agip Petroli. The saccharose laurate surfactant is a commercial product of the Biochim Company, consisting of a mixture of saccharose monolaurate and saccharose polylaurate (mainly saccharose dilaurate) in a weight ratio of 70:30. The produced is conducted at ambient temperature (20°–25° C.) by mixing increasing quantities of water with gasoline and adding to the obtained mixture metered quantities of a mixture of surfactant and co-surfactant in a mutual weight ratio of about 1.5:1 until transparent time-stable microemulsions are obtained, the compositions of which are given in Table 1 below.

TABLE 1

| Comp. No. | Water (% wt.) | Surfactant (% wt.) | Co-surfactant (% wt.) | Gasoline (% wt.) |
|---|---|---|---|---|
| 1 | 2.0 | 1.38 | 0.92 | 95.7 |
| 2 | 3.3 | 1.80 | 1.20 | 93.7 |
| 3 | 4.5 | 2.10 | 1.40 | 92.0 |
| 4 | 5.2 | 2.70 | 1.80 | 90.3 |
| 5 | 6.3 | 3.00 | 2.00 | 88.7 |
| 6 | 7.3 | 3.60 | 2.40 | 86.7 |
| 7 | 8.0 | 4.10 | 2.70 | 85.2 |
| 8 | 9.0 | 4.60 | 3.10 | 83.3 |
| 9 | 10.0 | 5.70 | 3.80 | 80.5 |

EXAMPLE 2

The procedure of Example 1 is followed using the surfactant and co-surfactant of Example 1, but using a leaded gasoline produced commercially by Agip Petroli. The results are given in Table 2 below.

TABLE 2

| Comp. No. | Water (% wt.) | Surfactant (% wt.) | Co-surfactant (% wt.) | Gasoline (% wt.) |
|---|---|---|---|---|
| 1 | 2.0 | 0.9 | 0.6 | 96.5 |
| 2 | 3.0 | 1.2 | 0.8 | 95.0 |
| 3 | 4.0 | 1.4 | 0.9 | 93.7 |
| 4 | 5.2 | 1.9 | 1.3 | 91.6 |
| 5 | 6.0 | 2.3 | 1.5 | 90.2 |
| 6 | 7.0 | 2.7 | 1.8 | 88.5 |
| 7 | 8.0 | 3.3 | 2.2 | 86.5 |
| 8 | 9.0 | 3.7 | 2.5 | 84.8 |
| 9 | 10.0 | 4.5 | 3.0 | 82.5 |
| 10 | 11.0 | 5.6 | 3.7 | 79.7 |

EXAMPLE 3

The procedure of Example 1 is followed using the co-surfactant of Example 1, but using a No. 2 diesel fuel produced commercially by Agip Petroli and a saccharose oleate ester consisting of a mixture of saccharose monooleate and dioleate in a 60:40 weight ratio as surfactant. The results are given in Table 3 below.

TABLE 3

| Comp. No. | Water (% wt.) | Surfactant (% wt.) | Co-surfactant (% wt.) | Diesel fuel (% wt.) |
|---|---|---|---|---|
| 1 | 2.0 | 1.8 | 1.2 | 95.0 |
| 2 | 3.2 | 2.3 | 1.6 | 92.9 |
| 3 | 4.2 | 2.9 | 2.0 | 90.9 |
| 4 | 5.2 | 3.5 | 2.3 | 89.0 |
| 5 | 6.4 | 4.5 | 3.0 | 86.1 |
| 6 | 7.0 | 4.8 | 3.2 | 85.0 |
| 7 | 8.2 | 5.6 | 3.8 | 82.4 |
| 8 | 9.0 | 6.6 | 4.4 | 80.0 |

EXAMPLE 4

The procedure of Example 1 is followed, using the surfactant and unleaded gasoline of said Example 1 but 1,2-dodecanediol as co-surfactant. In addition the weight ratio of surfactant to co-surfactant is varied in the various tests within a range of 1.6:1–2.8:1. The results are given in Table 4 below.

TABLE 4

| Comp. No. | Water (% wt.) | Surfactant (% wt.) | Co-surfactant (% wt.) | Gasoline (% wt.) |
|---|---|---|---|---|
| 1 | 4.0 | 2.5 | 0.9 | 92.6 |
| 2 | 5.4 | 2.8 | 1.0 | 90.8 |
| 3 | 6.8 | 4.9 | 2.1 | 86.2 |
| 4 | 7.3 | 5.8 | 3.6 | 83.3 |

We claim:

1. A hybrid fuel composition in the form of a stable water-in-oil microemulsion, comprising (a) 72 to 97.5 percent by weight of a liquid hydrocarbon fuel, (b) 1 to 13 percent by weight of water, (c) 0.9 to 9.6 percent by weight of a glycolipid surfactant comprised of a compound of the formula:

$$A—X—R \quad (I)$$

where:

A represents the glucide group of a mono-, di-, tri- or tetra-saccharide,

R represents a linear or branched chain alkyl group with at least 10 carbon atoms, and either saturated or containing one or more ethylenic unsaturations, X represents a group connecting together the two groups A and R, and chosen from ether, ester, acetal and hemiacetal functions, and (d) 0.6 to 6.4 percent by weight of a vicinal aliphatic diol co-surfactant comprised of a vicinal aliphatic diol of formula:

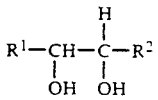

(II)

where:

$R^1$ represents a $C_4$–$C_{12}$ linear or branched alkyl group, possibly interrupted by one or more oxygen atoms or carboxy groups and possibly carrying one or more ethylenic saturations;

$R^2$ represents a hydrogen atoms, a methyl or ethyl group, or has the same meaning as $R^1$ with the weight ratio of surfactant to co-surfactant of between 1:1 and 2.1.

2. A hybrid composition as claimed in claim 1, wherein the liquid hydrocarbon fuel is selected from the group consisting of gasoline, diesel fuel and liquid fuels for domestic or industrial heating.

3. A hybrid composition as defined in claim 2 wherein said liquid fuel for domestic or industrial heating is selected from the group consisting of gas oil, naphtha, and kerosene.

4. A hybrid composition as claimed in claim 2, wherein the liquid hydrocarbon constituent is leaded or unleaded gasoline.

5. A hybrid composition as claimed in claim 4, comprising (a) 81–95 wt % of gasoline, (b) 3–10 wt % of water, (c) 1.2–5.4 wt % of glycolipid surfactant, and (d) 0.8–3.6 wt % of vicinal aliphatic diol co-surfactant.

6. A hybrid composition as define in claim 4 comprising (a) 73 to 97.5 percent by weight of gasoline, (b) 1 to 13 percent by weight of water, (c) 0.9–8.4 percent by weight of glycolipid surfactant, and (d) 0.6 to 5.6 percent by weight of vicinal aliphatic diol co-surfactant.

7. A hybrid composition as claimed in claim 2, wherein the liquid hydrocarbon constituent is diesel fuel.

8. A hybrid composition as claimed in claim 7, comprising (a) 80–93 wt % of diesel fuel, (b) 3–9 wt % of water, (c) 2.2–6.6 wt % of glycolipid surfactant, and (d) 1.4–4.4 wt % of vicinal aliphatic diol co-surfactant.

9. A hybrid composition as defined in claim 7 comprising (a) 72 to 96.5 percent by weight of diesel fuel, (b) 1 to 12 percent by weight of water, (c) 1.5 to 9.6 percent by weight of glycolipid surfactant, and (d) 1.0 to 6.4 percent by weight of vicinal aliphatic diol co-surfactant.

10. A hybrid composition as claimed in claim 1, wherein said saccharide in saccharose and the alkyl chain contains between 10 and 24 carbon atoms.

11. A hybrid composition as claimed in claim 10, wherein the glycolipid surfactant is selected from the group consisting of oleyl saccharose ether, tetradecyl saccharose ether, dodecyl saccharose ether, saccharose oleate ester, saccharose laurate ester and saccharose linoleate ester.

12. A hybrid composition as claimed in claim 1, wherein in said co-surfactant formula (II):

$R^1$ represents a linear or branched $C_5$–$C_{10}$ alkyl group; an $R^3$—COO—$CH_2$-alkylcarboxymethylenic group where $R^3$ represents a linear or branched $C_5$–$C_{10}$ alkyl group; or an $R^4$—O—($CH_2$—$CH_2$—O)$_n$-alkylethoxy group where $R^4$ represents a linear or branched $C_5$–$C_8$ alkyl group and n is 1 or 2; and $R^2$ represents a hydrogen atom.

13. A hybrid composition as claimed in claim 12, wherein said co-surfactant is selected from the group consisting of 1,2-octanediol, 1,2-nonanediol, 1,2-decanediol, 1,2-dodecanediol and, a glycerol monoester.

14. A hybrid composition as claimed in claim 1, wherein said liquid hydrocarbon fuel (a) comprises 80–95 wt %, water (b) comprises 3–10 wt %, glycolipid surfactant (c) comprises 1.2–6.6 wt % and vicinal aliphatic diol co-surfactant (d) comprises 0.8–4.4 wt %, with a weight ratio of surfactant to co-surfactant of 1.5:1.

* * * * *